US006032985A

United States Patent [19]

Cutter

[11] Patent Number: 6,032,985

[45] Date of Patent: Mar. 7, 2000

[54] LATCH ASSEMBLY

[75] Inventor: Ryan D. Cutter, Kensington, Conn.

[73] Assignee: Harrow Products, Inc., Grand Rapids, Mich.

[21] Appl. No.: 09/083,144

[22] Filed: May 22, 1998

[51] Int. Cl.[7] ..... E05B 65/10

[52] U.S. Cl. ..... 292/92; 292/DIG. 44; 292/93; 70/143; 70/92

[58] Field of Search ..... 292/92, 93, 227, 292/196, 332, 336, DIG. 44, 210, DIG. 72; 70/92, 143, 144, 157, 151 A, 151 R

[56] References Cited

U.S. PATENT DOCUMENTS

| | | | |
|---|---|---|---|
| 3,586,361 | 6/1971 | Ohno | 292/169 |
| 3,666,306 | 5/1972 | Genakis | 292/169.17 |
| 3,891,255 | 6/1975 | Millett | 292/169.13 |
| 3,898,822 | 8/1975 | Schlam | 70/143 |
| 3,930,677 | 1/1976 | Hollis | 292/169.13 |
| 4,083,590 | 4/1978 | Folger | 292/92 |
| 4,101,153 | 7/1978 | Dozier | 292/92 |
| 4,363,231 | 12/1982 | Kaveney, Jr. | 70/484 |
| 4,679,416 | 7/1987 | Kambic | 70/143 |
| 4,709,950 | 12/1987 | Zortman | 292/92 |
| 4,739,638 | 4/1988 | Lin | 70/129 |
| 4,801,163 | 1/1989 | Miller | 292/92 |
| 4,865,367 | 9/1989 | Choi | 292/92 |
| 4,887,442 | 12/1989 | Lavelle | 70/143 |
| 5,044,182 | 9/1991 | Totten | 70/143 |
| 5,219,385 | 6/1993 | Yeh | 70/92 |
| 5,566,991 | 10/1996 | Young | 292/201 |
| 5,615,919 | 4/1997 | Ivey | 292/322 |
| 5,820,177 | 10/1998 | Moon | 292/335 |

*Primary Examiner*—Darnell M. Boucher
*Assistant Examiner*—Clifford B Vaterlaus
*Attorney, Agent, or Firm*—Alix, Yale & Ristas, LLP

[57] ABSTRACT

A latch device, which is especially adapted for an exit bar, incorporates a trigger assembly. When the latch device is retracted and released, as ordinarily occurs when the door is opened, the latch bolt is biased to an intermediate extended position. The trigger engages the rim of the strike plate which in turn releases a retainer arm and allows the latch bolt to project to an extended position within the strike thereby providing a latch function of high integrity.

21 Claims, 6 Drawing Sheets

LATCH ASSEMBLY

BACKGROUND OF THE INVENTION

This invention relates generally to a latch assembly which is employed for latching a door to a frame. More particularly, this invention pertains to a latch assembly which is employed in conjunction with an exit bar.

Exit bars have traditionally been employed to facilitate exit through doors such as commonly found in public accommodations and large facilities. A number of latch assemblies have been devised for use in conjunction with the exit bar push pad and in conjunction with a latch or locking mechanism on the opposing side of the door to provide an efficient latch and unlatching function. For narrow stile doors, such as 2⅛ inch stiles, for example, the extension of the latch bolt in the latching position may interfere with the jamb tube of the door. Consequently, the integrity of the latching engagement between the latch bolt and the strike may be limited.

There are some structural applications where it is highly desired, and may be required by regulation, that the engagement of the latch bolt in the strike provide a latching function of high integrity. However, the latching function can be highly problematical with the narrow stile door frames. It is not inconceivable that a highly extended latch bolt could strike the door frame and fail to latch altogether.

SUMMARY OF THE INVENTION

Briefly stated, the invention in a preferred form is a latch device which is particularly adapted for use in conjunction with an exit bar or the like. The latch device comprises a frame which has a latch face. A latch bolt is projectable through an opening in the latch face. The latch bolt is biased by a spring toward an extreme extended position. A retainer assembly retains the latch bolt in an intermediate extended position. The latch bolt is retracted by means of a retraction assembly. A trigger assembly employs a trigger which is projectable through the latch face. The trigger is depressible for releasing the retainer assembly so that the latch bolt projects to an extended position.

The latch device is employed so that when the latch bolt is retracted and the door is open, the latch bolt projects to the intermediate position. When the door is closed, the latch bolt then is received in the strike, and the trigger is correspondingly depressed by the rim of the strike plate. This allows the latch bolt to be projected to an extended position in the strike. In addition, a pivotal blocking arm is automatically positionable to prevent the retraction of the latch bolt from the extreme extended position unless the latch bolt is retracted by the retraction assembly.

A slide assembly, which may also include a cam operator, cooperates with the push bar retraction sub-assembly for retracting the latch bolt. The cam operator comprises a pair of wings. Each wing engages a slide plate for retracting the latch bolt upon application of a rotating force in either a clockwise or a counterclockwise direction. A pin projects transversely from the trigger and engages the frame to limit the position of the trigger. The retainer assembly also includes a pivotal arm having a retention notch. A pin extends transversely from the latch bolt and is retainable in the notch to maintain the intermediate position of the trigger. The pin also may function as a stop. A spring biases the retainer arm into engagement with the trigger assembly.

An object of the invention is to provide a new and improved latch assembly having an efficient construction adapted for use with an exit bar.

Another object of the invention is to provide a new and improved latch assembly which is especially adapted to provide an extended latching function for door frames that have narrow stiles.

A further object of the invention is to provide a new and improved latch assembly adapted for use with an exit bar, which latch assembly provides a high degree of latching integrity without having an unduly extended latch bolt position when the latch is released.

Other objects and advantages of the invention will become apparent from the specification and the drawings.

DETAILED DESCRIPTION OF THE PREFERRED EMBODIMENT

Figure 1:
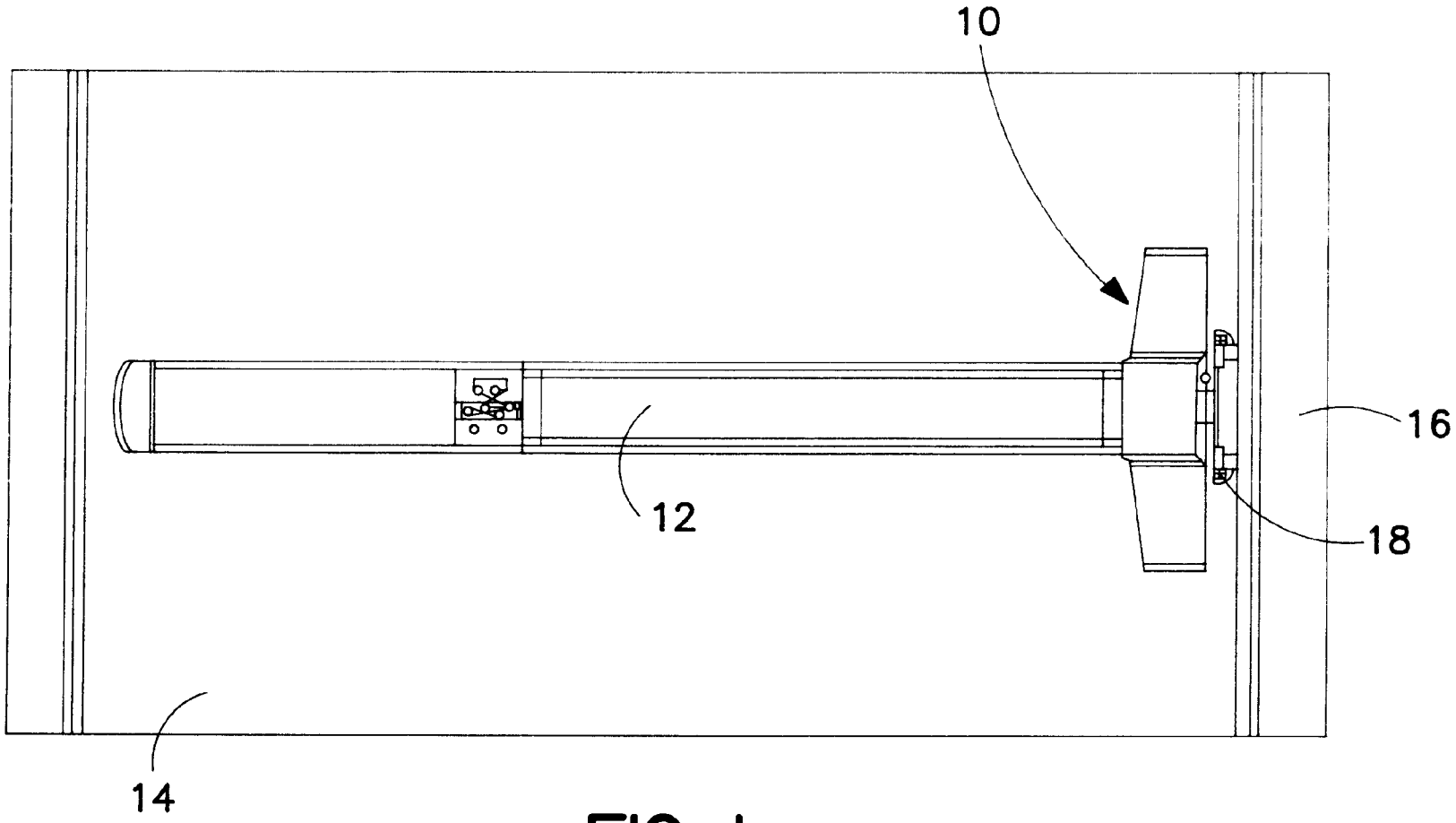
FIG. 1 is an elevational view of an exit bar incorporating a latch assembly in accordance with the present invention, said exit bar being mounted to a door which is latched to a frame.
Figure 2:
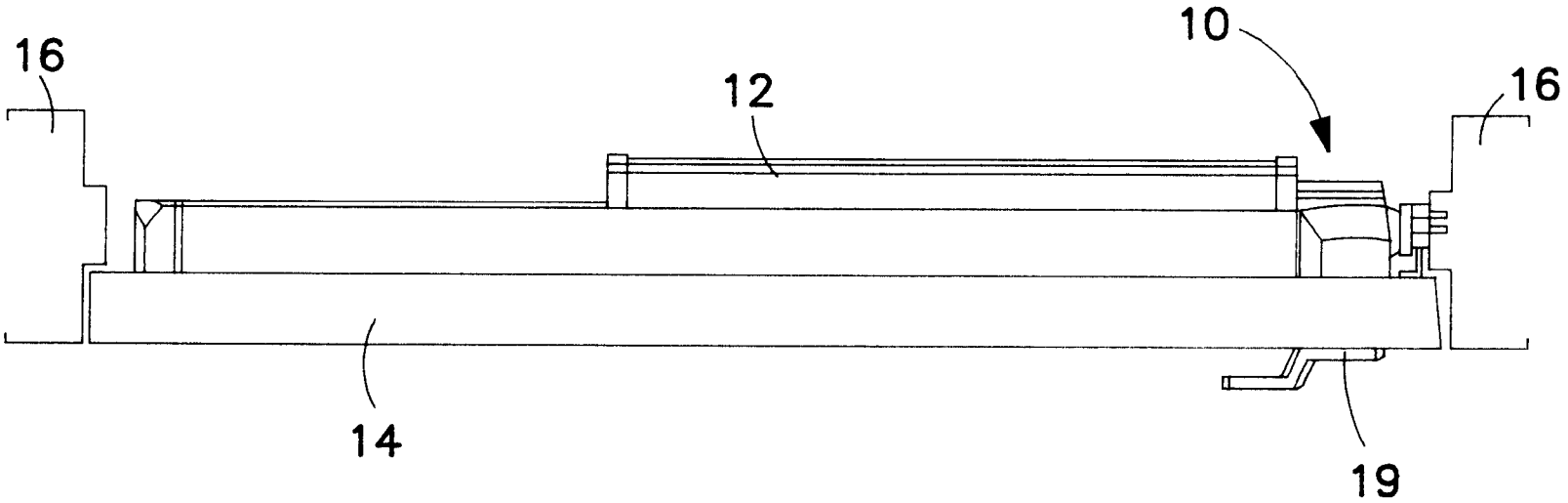
FIG. 2 is a top sectional view of the exit bar, latch assembly, door and frame of FIG. 1 taken along the line 2—2 thereof.

With reference to the drawings, wherein like numerals represent like parts throughout the figures, a latch assembly designated generally by the numeral 10 is employed in conjunction with an exit bar 12 for latching an exit door 14 to a door frame 16. The exit bar 12 is typically mounted to the interior of the exit door. The latch assembly 10 is particularly adapted for latching in conjunction with the strike 18 of a door frame which has a relatively narrow stile, such as, for example, on the order of a 2⅛ inch width.

As will be detailed below, the latch assembly 10 functions in an efficient manner wherein the latch bolt has an intermediate projected position (illustrated by the broken line position of FIG. 6) when the latch is released but in the fully latched position has an extended position (FIGS. 3, 4 and 5) which provides a latching function having a high degree of latching integrity. The latch assembly 10 is also adapted to function with an exterior rotatable trim operator 19, which may assume numerous conventional forms.

The latch assembly 10 comprises a latch housing 20 which may be described as having the general shape of a T-frame with opposed pairs of upstanding support plates. The extreme forward plate 22 has a latch face which, upon installation, opposes the strike 18 of the door jamb. The plate defines a pair of adjacent rectangular openings 24, 26. A pivotally mounted bolt 30 projects through the larger central opening. The latch bolt 30 has a conventional tapered configuration to facilitate reception in and retraction from the strike recess. The bolt 30 is mounted by a transverse pivot pin 32 which is mounted at upper frontal locations of the panels 21, 23. A torsion spring 34 coiled around pin 32 biases the latch bolt toward an extreme forward projected position. The extreme forward position is defined by a stop pin 36 which transversely projects from both sides of the bolt and engages the inside surface of the frontal plate 22. The extreme forward position of the latch bolt is illustrated by the solid lines of FIG. 6.

Figure 7:
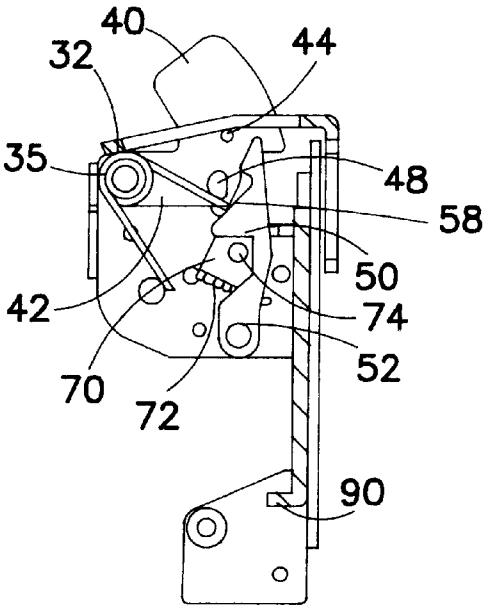
FIG. 7 is a sectional view of the latch assembly of FIG. 6 taken along the line 7—7 thereof.

The projected position of the latch bolt is controlled by a trigger 40. The trigger 40 has an arm 42 terminating in an annular yoke which pivotally mounts to the pin 32. The trigger 40 is biased by a trigger torsion spring 35 coiled around pin 32 for forward pivotal projection through the slot 26 in the latch face. Spring 35 is interposed between the trigger and the bolt. With reference to FIG. 7, a stop in the form of a pin 44 projects transversely from the side of the trigger and is engageable against the inside plate 22 defining the latch face. One end of spring 35 engages a transversely inward lug 48 of the trigger for biasing the trigger to the extended projected position.

Figure 5:
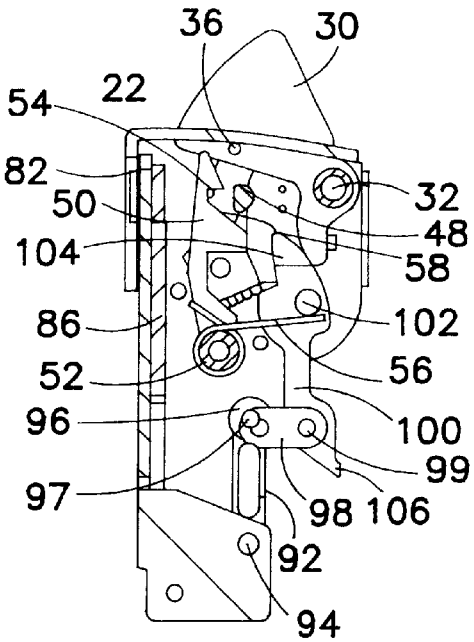
FIG. 5 is a sectional view of the latch assembly of FIG. 4 taken along the line 5—5 thereof.
Figure 6:
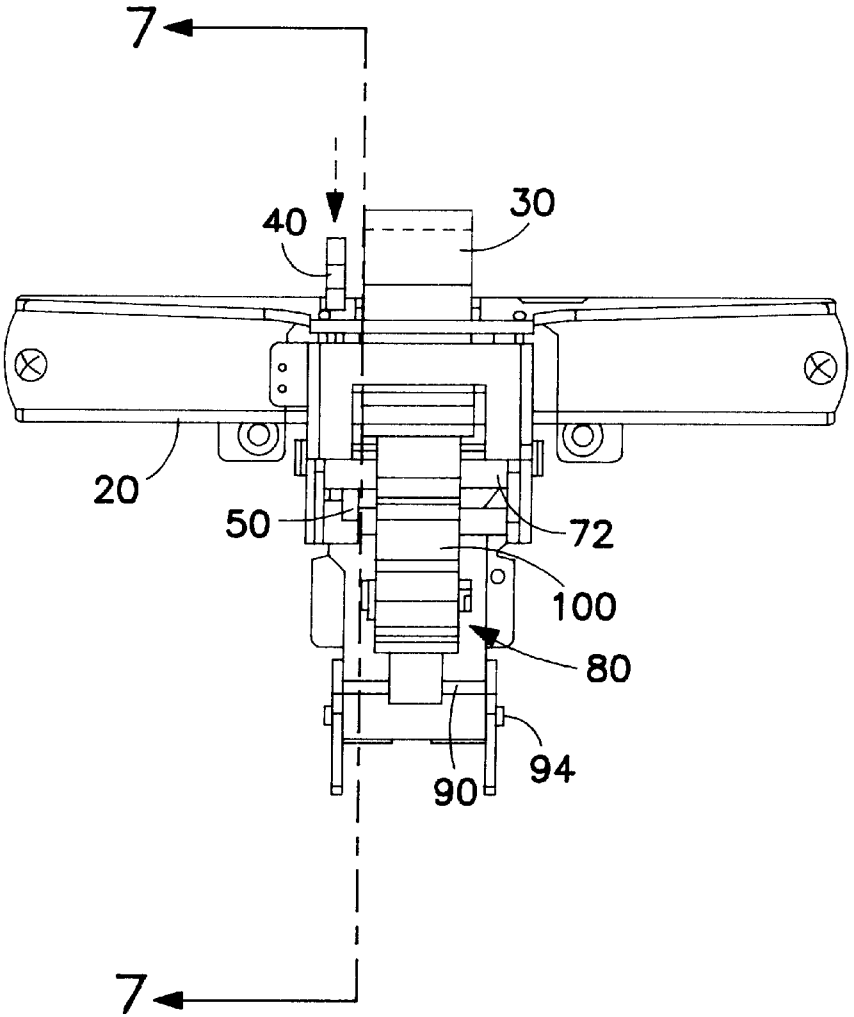
FIG. 6 is a side view, portions removed and partly in schematic, of the latch assembly of FIG. 1.
Figure 8:
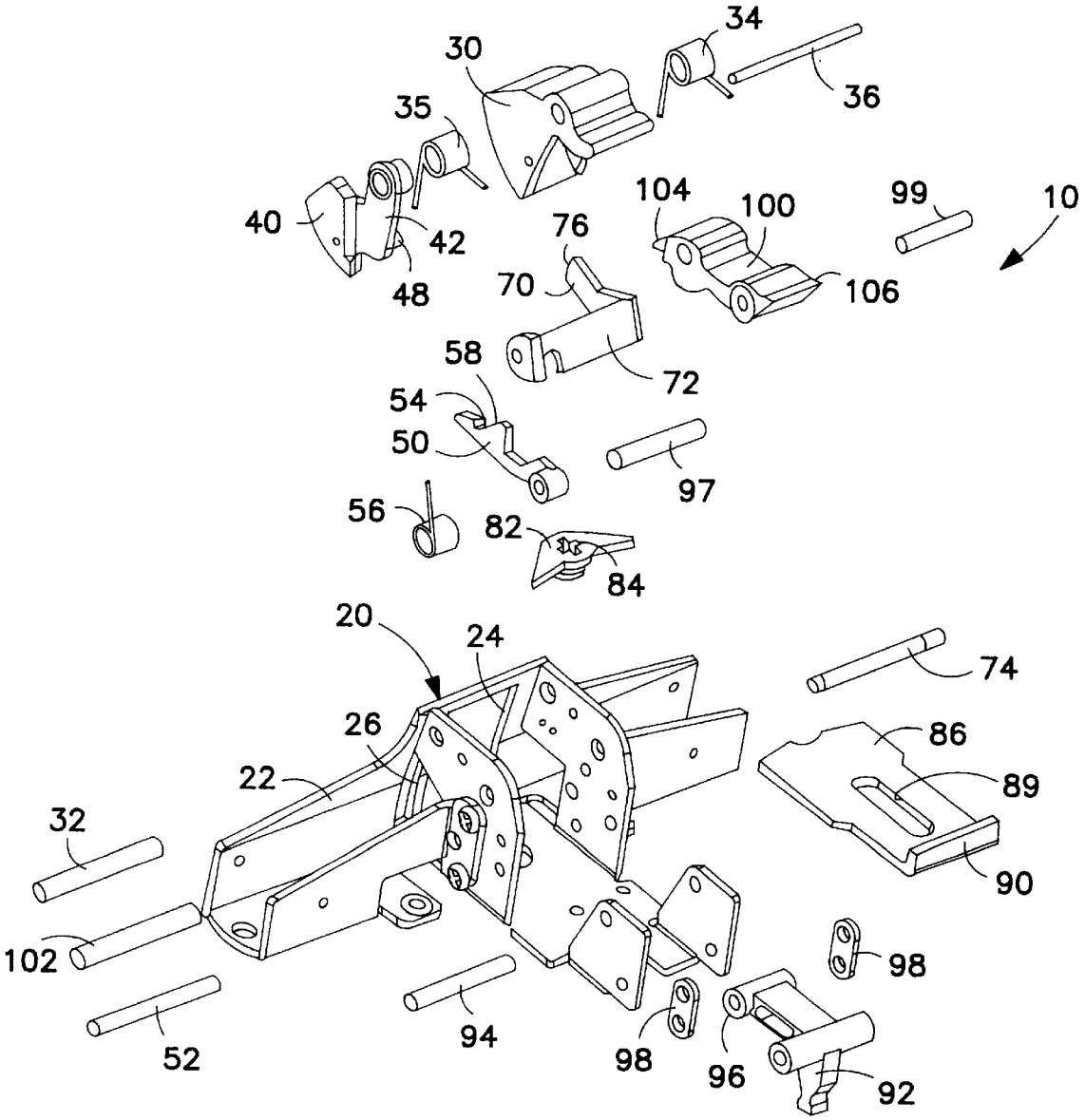
FIG. 8 is an exploded perspective view of the latch assembly of FIG. 1.

With additional reference to FIG. 5, a retaining arm 50 is pivotally mounted to the frame by means of a transverse pivot pin 52. The arm has a notch 54 at a distal location which receives and retains pin 36. A retaining arm torsion spring 56 wraps around the pin and engages the underside of the arm to bias the arm toward a pivotal position wherein the bolt via pin 36 is retained in the intermediate release position. The arm has a cam edge surface 58 which is engaged by the transverse lug 48 of the trigger. When the trigger is depressed (retracted) into the frame, the lug 48 rides the cam surface 58 and forces the retaining arm downwardly (toward the door). The bolt pin 36 releases from the notch 54 and the bolt projects forwardly to the extended position. The forward free end of the retaining arm 50 is transversely located between the bolt 30 and the trigger 40.

A dead latch arm 70 extends from a transverse platform 72 which is pivotally mounted to the frame by a pin 74. The ends of springs 34 and 35 engage the underside of the platform to bias the arm upwardly (away from the door). When the latch bolt is projected to the extended position, the stop pin 36 is trapped between the terminal end 76 of the arm and the inside surface of plate 22. This prevents retraction of the latch bolt. The latch arm pivots downwardly (toward the door) so that the pin 36 clears the end 76 when the latch bolt is retracted, as detailed below.

A dual function retraction assembly 80 is responsive to the trim operator 19 as well as the push bar 12 for retracting the latch bolt 30 to permit egress through the exit door.

A trim cam 82 is rotatably mounted at the bottom of the frame for bi-directional rotation in response to a torque applied from the trim operator 19. The trim cam 82 typically has an extended cross slot 84 for rotatably coupling with the operator 19. The trim cam has a transverse wing-shaped cam edge which engages the frontal edge of a trim slide 86. The trim slide 86 is retained by a screw/nut unit (not illustrated) extending through a central slot 88 to permit a longitudinal sliding of the trim slide. A bent end portion forms an upstanding lug 90 at the rear of the trim slide which longitudinally slidably engages a trim pivot 92 for retracting the bolt (releasing the latch).

The trim pivot 92 is a quasi-L-shaped member which is pivotally mounted to the rear of the frame by means of a transverse pin 94. With additional reference to FIG. 5, a forward extension of the pivot terminates in a yoke 96 which receives a pin link 97 which couples to a pair of slide links 98. The slide links 98 are, in turn, pivotally coupled at their upper portion to a lift link 100 which is pivotally mounted to the frame via transverse pin 102. The lift link has forward extension 104 which pivotally engages the underside of an integral rearwardly extending tongue 38 of the latch bolt. The lift link 100 has an upper rearward shoulder 106 which is engaged by the push bar assembly. Pin 102 functions as a fulcrum which causes the extension 104 to upwardly pivot against the bolt tongue 38 and thereby pivotally retract the latch bolt 30. The link 100 is downwardly pivotally moved by depressing the push bar to force the latch bolt to a release position wherein the bolt is fully retracted into the frame. The release position is also independently obtained by means of the trim cam 82 which forces the slide 86 rearwardly to also obtain the release position. The pivotal motion about pin 102 is transmitted by pivoting of the link pivot about pin 94 via links 98. The bolt spring 34 normally biases the link 100 to the non-retracted (upper) position.

Figure 3:
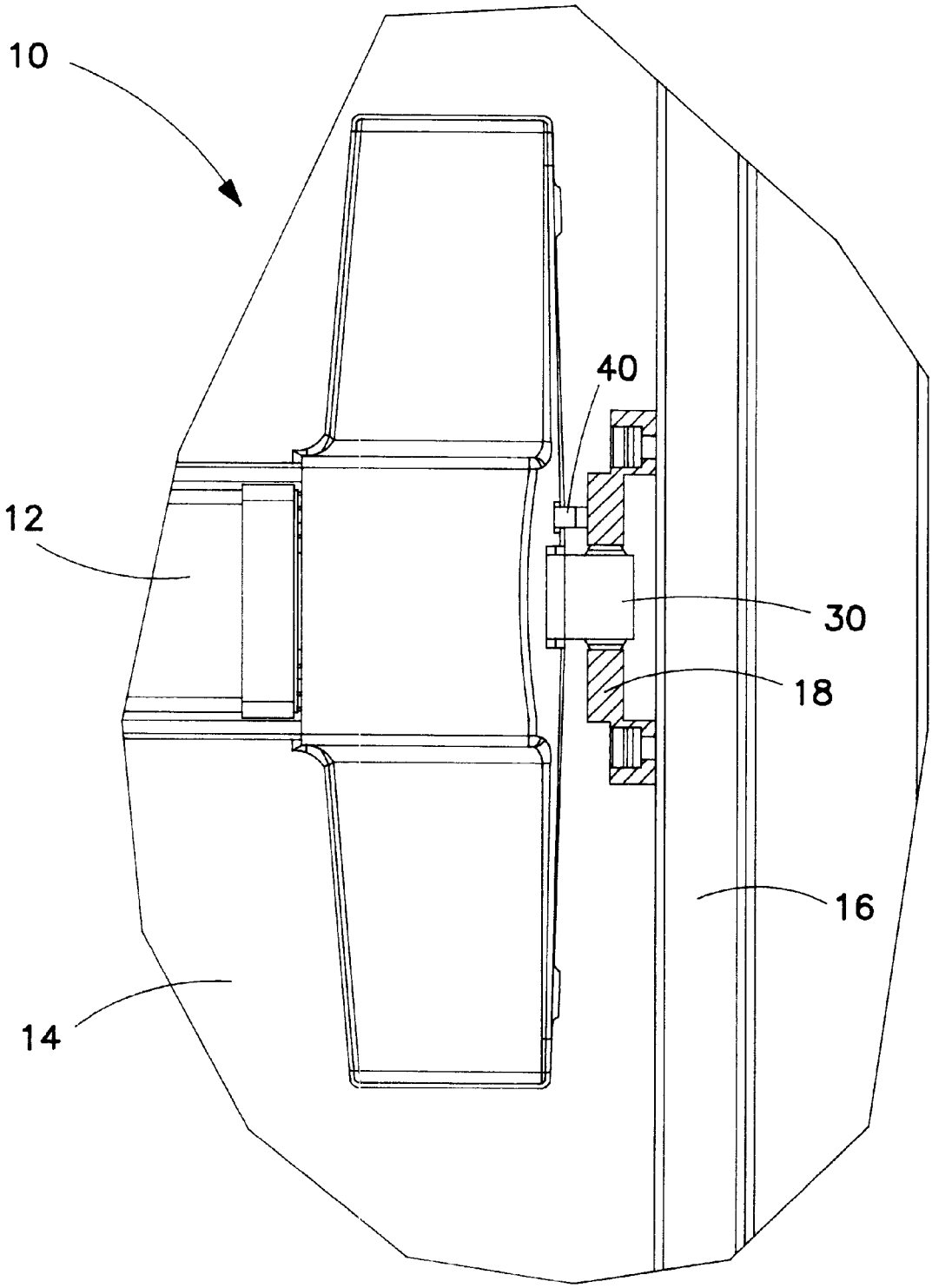
FIG. 3 is an enlarged fragmentary view, partly broken away and partly in section, illustrating the latch assembly and latching hardware and fragmentary portions of the exit bar, door and frame of FIG. 1.
Figure 4:
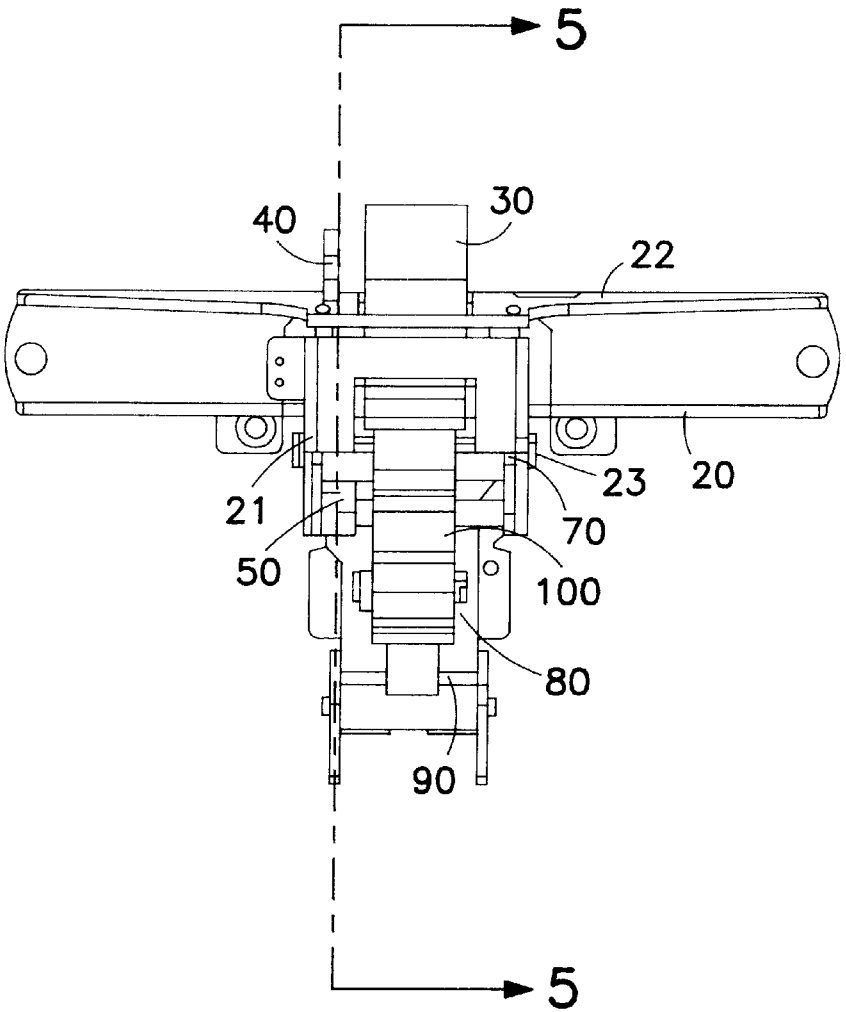
FIG. 4 is a side view, portions removed, of the latch assembly of FIG. 1.

When the trigger is in the forward unactuated position and the trim cam is neither rotated nor the push pad activated, the latch bolt assumes the intermediate retained position. When the latch bolt enters the strike, the trigger engages the adjacent rim of the strike and is depressed inwardly into the housing, as best illustrated in FIG. 3. The retaining arm is forced downwardly, and the bolt pin 36 releases from the notch. The bolt is projected under the bias of the spring 34 to the extreme extended position illustrated in FIG. 3. The position is defined by pin 36 engaging the interior surface of plate 22. The dead latch arm 70 synchronously pivots to obstruct retraction of the latch bolt from the extended position. The pin 36 is trapped between the plate 22 and the end 76 of the latch arm.

When the latch is released by either the trim cam from the exterior of the door or by means of the push pad downwardly exerted against the lift link 100, the latch bolt is pivotally retracted, and the trigger then extends forwardly to retain the release latch (pin 36 in notch 54) in the intermediate position.

It will be appreciated that the latch assembly provides an efficient means wherein the latch bolt may be normally projected to an intermediate position when the latch is released. Upon projecting the latch bolt into the strike, the trigger engages the strike rim and forces the latch to an extended position. The extended position of the latch bolt provides a high degree of latching integrity and is particularly applicable for door jambs which have a narrow stile configuration.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A latch device for an exit bar comprising:

a frame comprising a latch face defining an opening;

a latch bolt pivotably mounted on a first pin to said frame and projectable through said opening;

a spring for biasing said latch bolt toward an extended position;

a retraction assembly for retracting said latch bolt into said opening;

a retainer assembly for retaining said latch bolt in an intermediate position upon release of said retraction assembly; and a trigger assembly comprising a trigger with a first end pivotably mounted to said frame and projectable through said latch face and depressible means for releasing said retainer assembly so that said latch bolt projects to the extended position.

2. The latch device of claim 1 further comprising a pivotal block arm which is positionable to prevent retraction of said latch bolt when said latch bolt is in the extended position.

3. The latch device of claim 1 wherein said retraction assembly for retracting said latch bolt further comprises a slide assembly comprising a displaceable slide plate.

4. The latch device of claim 3 wherein said slide assembly further comprises a cam operator.

5. The latch device of claim 4 wherein said cam operator comprises a pair of wings engageable against said slide plate for retracting said latch bolt upon application of a rotating force in either a clockwise or a counterclockwise direction.

6. The latch device of claim 1 wherein a stop pin is mounted to and projects transversely from the trigger and engages the frame to limit the trigger projection.

7. The latch device of claim 1 wherein said retainer assembly comprises an arm pivotably mounted at a first end, having a retention notch at an opposing second end and a pin extends from said bolt and is retainable in said notch in said intermediate position.

8. The latch device of claim 7 further comprising a spring for biasing said pivotal arm into engagement with said trigger assembly.

9. A latch device for an exit bar comprising:

a frame defining an opening;

a bolt assembly mountable to said frame and comprising a latch bolt pivotable about a first pin to an extended position and retractable to a retracted position;

a retainer assembly for retaining said latch bolt in an intermediate position between said extended and retracted positions;

a retraction assembly for retracting said latch bolt toward said retracted position; and a trigger assembly comprising a trigger with a first end pivotably mounted to said frame and activatable means for releasing said retainer assembly so that said latch bolt projects from the intermediate position to the extended position.

10. The latch device of claim 9 further comprising a pivotal block arm which is positionable to prevent retraction of said latch bolt to said retracted position when said latch bolt is in the extended position.

11. The latch device of claim 9 wherein said retraction assembly comprises a pivotal first member and a second depressible member for retracting said latch bolt and further comprising a slide assembly engageable with said first member for retracting said latch bolt.

12. The latch device of claim 11 wherein said slide assembly further comprises a cam operator.

13. The latch device of claim 12 wherein said cam operator comprises a pair of wings which engages a slide plate for retracting said latch bolt upon application of a rotating force in either a clockwise or a counterclockwise direction.

14. The latch device of claim 9 wherein a pin is mounted to and projects transversely from the trigger and engages the frame to limit the forward position of the trigger.

15. The latch device of claim 9 wherein said retainer assembly comprises an arm pivotably mounted at a first end, having a retention notch an opposing second end and a pin extends from said bolt and is retainable in said notch in said intermediate position.

16. The latch device of claim 15 further comprising a spring for biasing said pivotal arm into engagement with said trigger assembly.

17. The latch device of claim 16 wherein said trigger comprises a transverse lug which engages said pivotal arm to release said pin from said notch.

18. A latch device for an exit bar comprising:

a frame defining an opening;

a bolt assembly mountable to said frame and comprising a latch bolt pivotable about a first pin through said opening to an extended position and retractable to a retracted position, a second pin extending from said bolt;

a retainer assembly for retaining said latch bolt in an intermediate position between said extended and said retracted positions, said retainer assembly including a pivotal arm having a retention notch, said second pin retainable in said notch in said intermediate position;

a spring for biasing said pivotal arm into engagement with said trigger assembly;

a retraction assembly comprising a depressible member for retracting said latch bolt toward said retracted position; and a trigger assembly comprising a trigger biased to an extended position and retractable to a retracted position with a transverse lug which engages said pivotal arm to release said second pin from said retention notch so that said latch bolt projects from the intermediate to the extended position.

19. The latch device of claim 18 further comprising a pivotal block arm which is positionable to prevent retraction of said latch bolt to said retracted position when said latch bolt is projected to the extended position.

20. The latch device of claim 18 wherein said retraction assembly comprises a pivotal first member and further comprises a slide assembly engageable with said pivotal first member for retracting said latch bolt.

21. The latch device of claim 1 wherein said first pin pivotably mounts both said latch bolt and said trigger.

* * * * *